US009375098B2

(12) United States Patent
Sun

(10) Patent No.: US 9,375,098 B2
(45) Date of Patent: Jun. 28, 2016

(54) WEIGHTED PUSHER ROLLING SHELVING ASSEMBLY

(71) Applicant: Sungal Corporation, Westport, CT (US)

(72) Inventor: Yeyang Sun, Westport, CT (US)

(73) Assignee: SUNGAL CORPORATION, Westport, CT (US)

( * ) Notice: Subject to any disclaimer, the term of this patent is extended or adjusted under 35 U.S.C. 154(b) by 0 days.

(21) Appl. No.: 14/540,616

(22) Filed: Nov. 13, 2014

(65) Prior Publication Data

US 2015/0129521 A1 May 14, 2015

Related U.S. Application Data

(60) Provisional application No. 61/904,117, filed on Nov. 14, 2013.

(51) Int. Cl.
*A47F 1/04* (2006.01)
*A47F 1/12* (2006.01)

(52) U.S. Cl.
CPC ..... *A47F 1/125* (2013.01); *A47F 1/126* (2013.01)

(58) Field of Classification Search
CPC ..... A47F 1/125; A47F 1/126; A47F 1/12; A47F 1/04; A47F 1/00; A47F 3/02; A47F 7/28
USPC ..... 211/59.3, 151, 59.2, 184, 175
See application file for complete search history.

(56) References Cited

U.S. PATENT DOCUMENTS

| | | | | | |
|---|---|---|---|---|---|
| 5,088,607 | A * | 2/1992 | Risafi et al. | ..... | 211/59.3 |
| 6,164,462 | A * | 12/2000 | Mumford | ..... | 211/59.2 |
| 8,051,781 | B1 * | 11/2011 | Vind et al. | ..... | 108/42 |
| 8,376,154 | B2 | 2/2013 | Sun | | |
| 2003/0132181 | A1 * | 7/2003 | Saulnier-Matteini | ..... | 211/153 |
| 2007/0045479 | A1 * | 3/2007 | Nguyen | ..... | 248/49 |
| 2007/0272634 | A1 * | 11/2007 | Richter et al. | ..... | 211/59.3 |
| 2010/0025346 | A1 * | 2/2010 | Crawbuck et al. | ..... | 211/59.3 |
| 2010/0133219 | A1 * | 6/2010 | Sun | ..... | 211/151 |
| 2010/0206829 | A1 * | 8/2010 | Clements et al. | ..... | 211/162 |
| 2010/0276383 | A1 * | 11/2010 | Hardy | ..... | 211/59.3 |
| 2012/0118840 | A1 * | 5/2012 | Howley | ..... | 211/59.3 |
| 2012/0217212 | A1 * | 8/2012 | Czalkiewicz et al. | ..... | 211/59.2 |

* cited by examiner

*Primary Examiner* — Basil Katcheves
(74) *Attorney, Agent, or Firm* — Ohlandt Greeley Ruggiero & Perle L.L.P.

(57) ABSTRACT

Disclosed is a weighted pusher assembly for advancing merchandise packages by gravity along an inclined shelf surface. The weighted pusher assembly includes a first end comprised of a weighted member, a second end comprised of a fastener and, disposed between the first and second ends, a collapsible member that is collapsible between a first extended position and a second collapsed position. The weighted member is adapted to be disposed proximal to the merchandise package and a first edge of the shelf and the fastener is adapted to be disposed distal the merchandise package and fastened to a second edge of the shelf. The collapsible member is preferably adapted to collapse substantially completely in a direction substantially perpendicular to the inclined shelf surface. The weighted member may be a hollow structure that is filled with a material to give it mass, but can also be a solid structure.

8 Claims, 13 Drawing Sheets

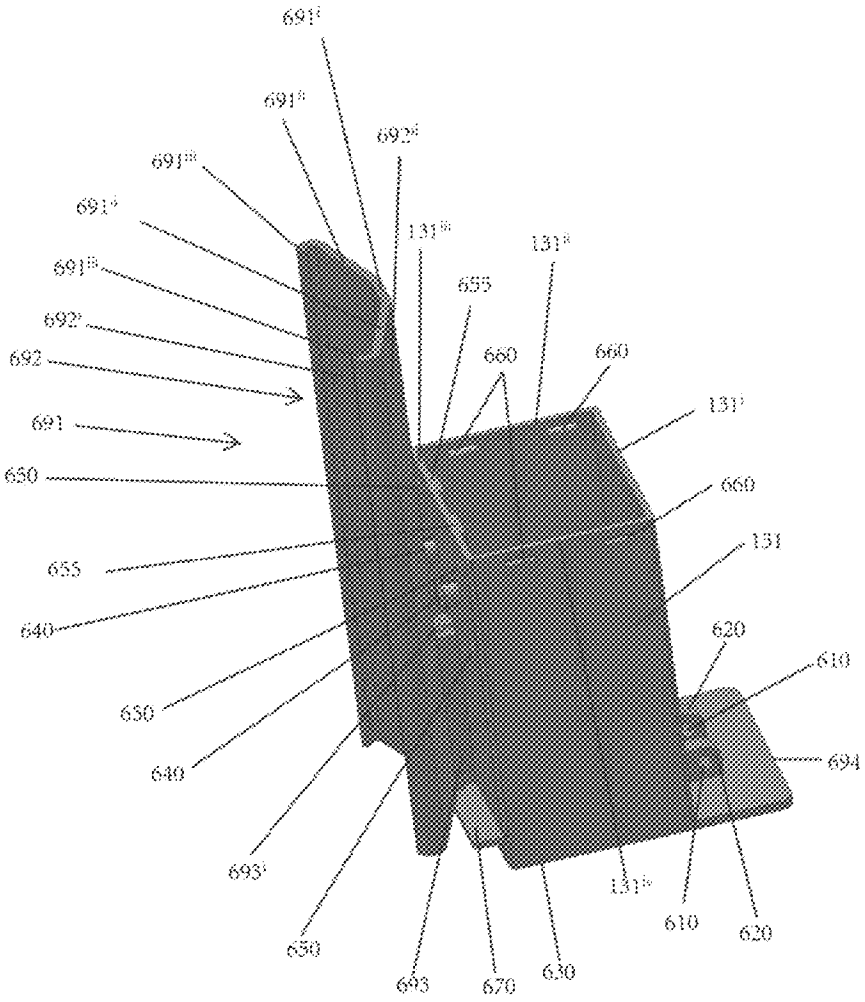
691'
691''
692''
131''
655
660
131'
660
131
620
610
694
620
610
131''
630
670
695
650
695'
640
650
640
655
650
691
692
692'
691''

WEIGHTED PUSHER ROLLING SHELVING ASSEMBLY

CROSS REFERENCED APPLICATION

This application claims priority to and the benefit of U.S. Provisional Application No. 61/904,117, filed on Nov. 14, 2013, and incorporates the disclosure of that application as if fully set forth herein in its entirety.

BACKGROUND

1. Field of the Disclosure

The present disclosure relates generally to shelves having a mechanism for moving an item thereon via gravity. More particularly, the present disclosure relates to shelves that may be inclined and have rollers thereon and a mechanism to advance an item on the shelves forward to an area where purchasers may see and retrieve the item.

2. Description of Related Art

Items, such as, medicines packaged in boxes or bottles, may be displayed in rows on a shelf having a mechanism that advances the items so that when one of the items is removed, another of the items is advanced and remains displayed. One such configuration is a spring-pusher system that includes a spring-loaded pusher member. When an item within a row is removed, the spring-loaded pusher member urges another item to the position of the removed item. Undesirably however, the force of the spring-loaded pusher member on the items often makes it difficult to remove the items from the row and/or to insert items into the row (either by restocking or by a customer who has changed her/his mind). The force of the spring-loaded pusher member of such systems can result in package damage, particularly when inserting packages and even more so for the front-most package in the row (causing product and revenue loss), as well as causing difficulty in replacing packages by customers who change their minds in product selection. This second problem results in a customer often throwing packages everywhere or, at the least, leaving packages in an untidy state. Also undesirably, the cost of installation of such spring-loaded pusher member shelf systems is quite high; this is a deterrent for many potential customers (stores) to install these systems.

Another type of shelving system utilizes a gravity actuated roller pin system. Undesirably, such shelving systems are made from numerous parts, e.g., 18 to 24 parts that must be assembled, thereby increasing labor and cost for both installation and repair. These shelving systems typically include separate roller tracks having individual metal backing supports that may undesirably bend and/or twist due to their individual roller track design. The bending and/or twisting can cause items to fall off of the display, which is also undesirable.

Additionally, such conventional gravity roller shelving systems have rollers loosely disposed on a base portion, each roller in its own holding chamber or cut-out and a retainer strip is placed over all of the rollers in a row in order to secure them to the base portion. Thus, if one roller needs to be removed and replaced, the retainer strip has to be removed, which frees all of the rollers from the base portion allowing other rollers to accidentally dislodge from the base. Moreover, the retainer strip placed over the rollers is attached to the assembly via screws, and should one of the screws become loose all of the rollers can become misaligned, inhibiting or preventing rollers from rotating.

An improved gravity roller shelving system having a simplified design and more efficient operation is described in U.S. Pat. No. 8,376,154.

Notwithstanding the foregoing, for state-of-the-art shelving systems, thinner, light-weight and/or small merchandise packages (as used herein, the term "merchandise package" includes merchandise with or without a package) present problems for gravity roller shelves or other shelving systems. These types of merchandise packages tend to not advance forward correctly along the rollers, or not forward at all, because the merchandise packages have insufficient weight. This results in the situation where the forward-urging gravitational force cannot overcome the friction between the merchandise package and the shelf. Furthermore, these merchandise packages tend to fall down backward when one pushes packages back to insert another package between front stop and front-most package. Merchandise package types, such as digestives, eye care, and coughs and cold remedies contain large quantities of thinner, light-weight and/or small packages. A workable, effective and economic solution for these merchandise packages would be desirable.

Thus, there is a need for a shelving system that moves thinner, lighter weight and/or small merchandise packages forward as the front-most merchandise package is removed from the shelf, allows for efficient and easy re-stocking of merchandise on the shell without allowing the lightweight merchandise packages to fall backwards as the shelf is restocked, does not compromise space within the shelf so that the items need not be replenished more often (as is the case with a spring-loaded pusher member), and allows for easy removal of the thinner, lighter weight and/or smaller merchandise packages.

SUMMARY

Accordingly, it is an object of the present disclosure to provide a shelving system that moves thinner, lighter weight and/or small merchandise packages forward as the front-most merchandise package is removed from the shelf.

It is another object of the present disclosure to provide a shelving system that allows for efficient and easy re-stocking of merchandise packages on the shelf without allowing the lightweight merchandise packages to fall backwards as the shelf is re-stocked.

It is a further object of the present disclosure to provide a shelving system that does not suffer from the shortcomings of shelving systems that include a spring-loaded pusher member, such as package damage, difficulty in replacing packages, and high cost of installation.

It is an additional object of the present disclosure to provide a shelving system that allows for easy removal of the thinner, lighter weight and/or smaller merchandise packages.

The above and other objects are met by the present disclosure of a weighted pusher assembly for advancing a merchandise package by gravity along an inclined shelf surface, the weighted pusher assembly comprising a first end comprised of a weighted member, a second end comprised of a fastener and, disposed between the first and second ends, a collapsible member collapsible between a first extended position and a second collapsed position, wherein the weighted member is adapted to be disposed proximal to the merchandise package and a first edge of the shelf, wherein the fastener is adapted to be disposed distal the merchandise package and fastened to a second edge of the shelf, and wherein the collapsible member is adapted to collapse in a direction substantially perpendicular to the inclined shelf surface.

Preferably, the inclined shelf surface is comprised of a gravity roller shelf having the first edge positioned so as to be proximal a merchandise package purchaser and the second edge positioned so as to be distal from a merchandise package purchaser.

The weighted member can be a solid plate of sufficient dimension and mass so as to effectively advance the merchandise packages forward along the shelf in the direction of a purchaser. The weighted member, if a solid plate, may have the mass adjusted by the application of, e.g., weighted strips. Preferably, the weighted member comprises a hollow shape, e.g., a rectangular or square shape, having a hollow interior space that is adapted to receive a substance providing desired mass to the weighted member. The substance providing desired mass may be a metal beads, sand, concrete, or any other substance desired. The weighted member is preferably adapted to be attached to the collapsible member via a hinge mechanism.

The fastener is, preferably, adapted to be affixed to the second edge of the shelf, such that the fastener provides longitudinal stability to the weighted pusher assembly such that the weighted member can effectively advance the merchandise packages and such that the fastener can withstand the force applied to the weighted pusher assembly during restocking. Also preferably, the fastener is adapted to be attached to the collapsible member via a hinge mechanism The collapsible member is preferably designed of a plurality of arms, each arm connected to another via a hinge mechanism. The collapsible member is also preferably designed so as to be disposed in a substantially completely perpendicular position with respect to the shelf surface. Also preferably, the collapsible member is comprised of a minimum number of arms, collapsible one toward another via hinges such that, when collapsible member is completely collapsed, the collapsible member does not contact any shelf located above it.

The above-described and other advantages and features of the present disclosure will be appreciated and understood by those skilled in the art from the following detailed description, drawings, and appended claims.

BRIEF DESCRIPTION OF THE DRAWINGS

FIG. 2A is a detail view of "A" of FIG. 2;

FIGS. 6E and 6F show alternative embodiments of weighted member of the weighted pusher assembly of FIG. 1;

DETAILED DESCRIPTION OF THE PREFERRED EMBODIMENT

Referring to FIGS. 1-7, an exemplary embodiment of a weighted pusher assembly according to the present disclosure is shown. In FIGS. 1-7, like numbers denote like elements.

Figure 1:
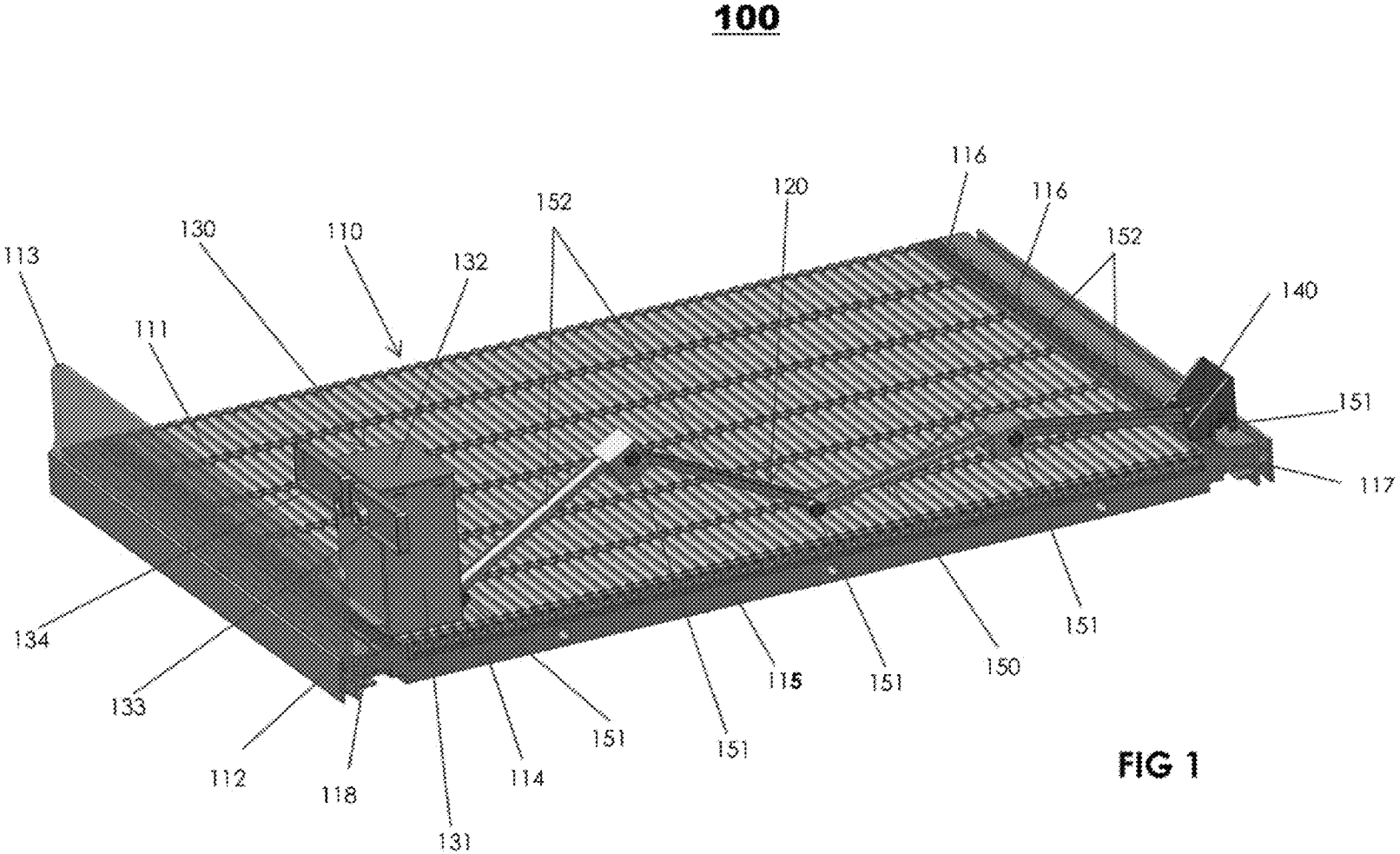
FIG. 1 is a right side perspective view of a weighted pusher assembly of the present disclosure having a collapsible member in an extended position.

FIG. 1 shows an embodiment according to the present disclosure of a shelf assembly 110 and a weighted pusher assembly 120 that together are generally referred to by reference numeral 100. In the particular embodiment shown in FIG. 1, shelf assembly 110 is comprised of a series of rollers 111, a front extension 112, a front stop 113, a rolling shelf base 114, a rolling shelf support bar 115, rear divider slots 116, rear extension 117 and front divider slots 118. It should be noted that shelf assembly 110 does not form part of the present disclosure, but is merely presented for purposes of reference and explanation of the embodiment of a weighted pusher assembly shown in FIGS. 1-7. Weighted pusher assembly 120 in the embodiment shown in FIG. 1 is comprised of a weight box assembly 130, a back holder 140 and collapsible member assembly 150. In the embodiment shown in FIG. 1, weight box assembly 130 includes a weight box 131, a weight box lid 132, a right extension panel 133 and a left extension panel 134. Collapsible member assembly 150 is comprised of a series of hinges 151 and arms 152. In the embodiment shown in FIG. 1, weighted pusher assembly 120 is shown having collapsible member 150 in an extended position, i.e., having advanced all or substantially all of merchandise packages (not shown) disposed on shelf assembly 110 forward to front stop 113.

Figure 4:
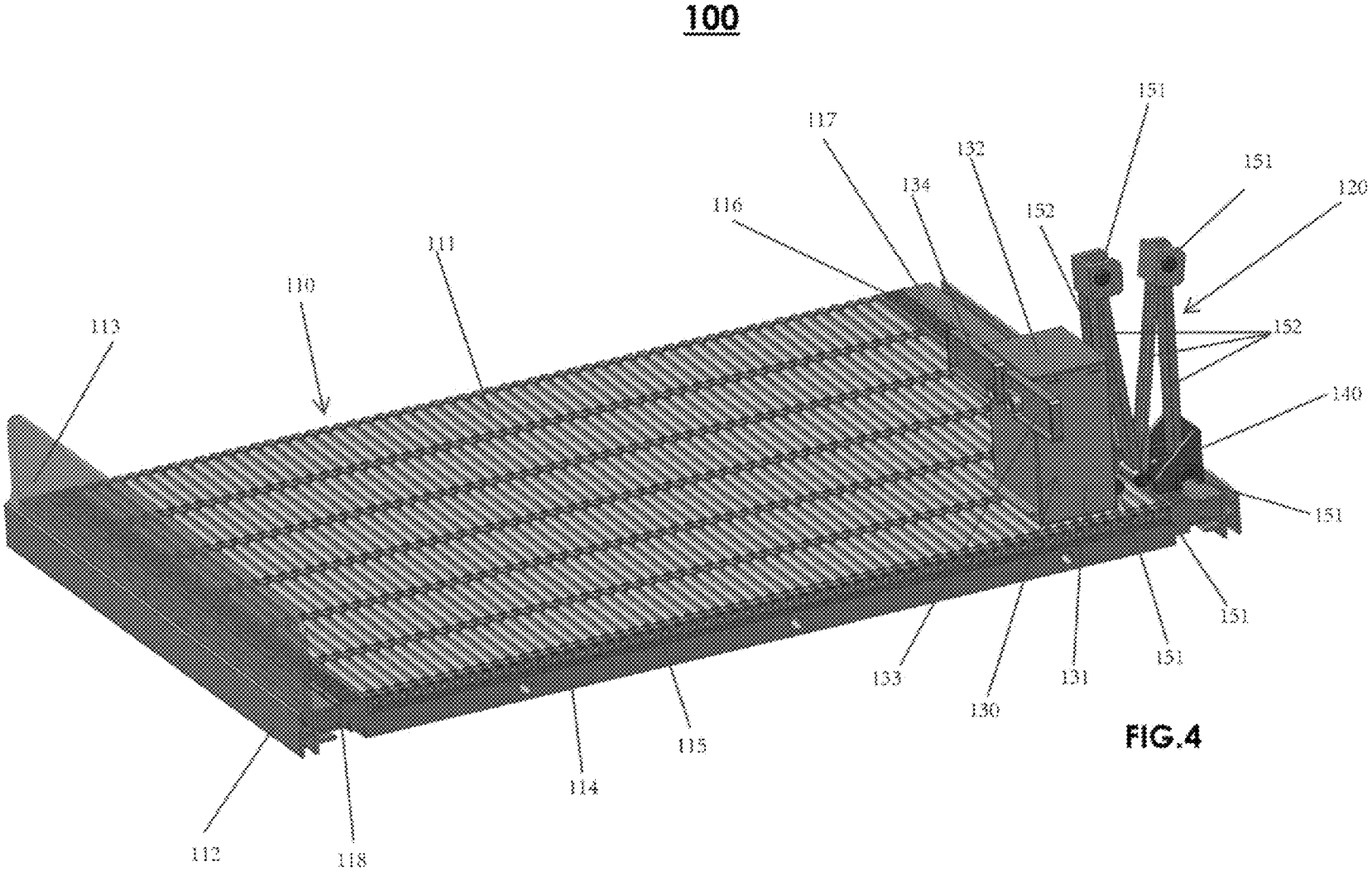
FIG. 4 is right side perspective view of the weighted pusher assembly of FIG. 1. of the present disclosure having the collapsible member in a collapsed position.
Figure 4A:
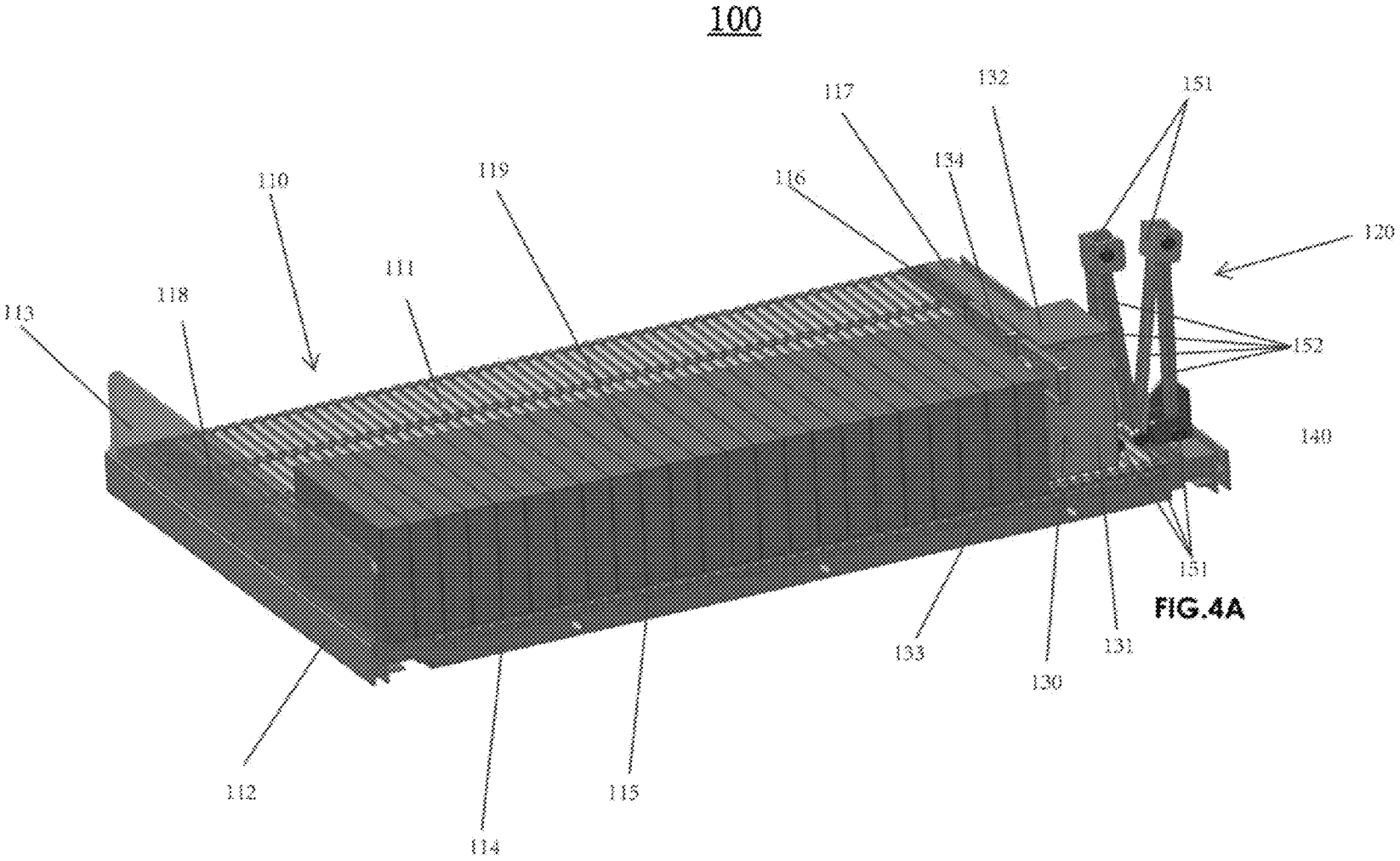
FIG. 4A shows the weighted pusher assembly of FIG. 4 having merchandise packages in place.

FIG. 4 shows the embodiment of shelf assembly 110 and weighted pusher assembly 120 combination 100 with weighted pusher assembly 120 having collapsible member 150 in a substantially completely collapsed position, i.e., having shelf assembly substantially completely full of merchandise packages (see, FIG. 4A) ready to be advanced on shelf assembly 110 to front stop 113. As noted, FIGS. 4 and 4A show weighted pusher assembly 120 when merchandise packages fully occupy shelf assembly 110. Under these circumstances, arms 152 are collapsed toward and proximal to back holder 140 as weight box 131 is moved to its rear-most position. In the preferred embodiment shown in FIGS. 1, 4 and 4A, all arms may be nearly perpendicular to shelf assembly 110. In this position, weighted pusher assembly 120 possesses its maximum potential energy for advancing merchandise packages forward down the incline of shelf assembly 120.

In the embodiment shown in FIGS. 1, 4 and 4A, shelf assembly 110 is comprised of a roller shelf that is generally disposed to display merchandise in a slightly inclined position with the end of shelf assembly 110 generally located at rear extension 117 higher than the end of shelf assembly 110 generally located at front stop 113. The slight incline is usually in the range of 4-7 degrees and more usually in the range of 5-6 degrees, but may be more or less depending on the particular installation. In this inclined configuration, weight box assembly 130 advances by gravity away from rear extension 117 toward front stop 113. While advancing by gravity, weight box assembly 130 pulls collapsible member 150 gradually from a substantially vertical position (i.e. collapsed position) relative to shelf assembly 110 (as shown in FIGS. 4 and 4A) to a substantially completely horizontal position (i.e. extended position) relative to shelf assembly 110. As seen in FIG. 1, when weight box assembly 130 is fully advanced proximal front stop 113 of shelf assembly 110, collapsible member 150, although nearly fully extended to a horizontal position, has two points of intersection of arms 152 at a slightly elevated position relative to three points of intersection. To explain in more detail, referring to hinge 151 that is between weight box 131 and adjacent arm 152 as hinge number "1" and referring to hinge 151 that is between back holder 140 and adjacent arm 152 as hinge number "5", hinge number "2" and hinge number "4" are disposed at or slightly elevated positions relative to hinges "1", "3" and "5". In the embodiment shown in FIGS. 1, 4 and 4A, the relative positioning of the hinges between arms 152 as described above is provided so that, as merchandise packages (not shown) are replaced on shelf assembly 110, collapsible member 150 more easily adopts a collapsed position (as shown in FIGS. 4 and 4A).

In the embodiment shown in FIGS. 1, 4 and 4A, weighted pusher assembly 120 includes weight box assembly 130, back holder 140 and collapsible member 150 in which collapsible member 150 includes five (5) hinges 151 and four (4) arms 152. In an alternative embodiment, collapsible member 150 may include as few as two (2) arms, i.e., one (1) arm connected to weight box 131 by a hinge 151 and one (1) arm connected to back holder 140 by a hinge 151, with one (1) hinge 151 connecting the two arms 152. In another alternative embodiment, collapsible member 150 may comprise a plurality of tubes inserted one into the other and attached to both weight box 131 and back holder 140. In this configuration, as weight box 131 moves away from back holder 140 when a merchandise package (not shown) is removed, the plurality of tubes inserted one into the other extend outwardly, one from the other, without the use or need for springs. In another alternative embodiment, collapsible member 150 may comprise a plurality of tubes inserted into each other and attached to each other by, e.g., hinge(s) 151 at one end and to weight box 131 by a hinge 151 (similar to that shown in FIGS. 1, 4 and 4A) and attached at another end to an arm 152 which, in turn, is attached to back holder 140 by hinge 151. In this configuration, the plurality of tubes and arm 152 may also collapse into a substantially vertical configuration substantially perpendicular to the inclined surface of shelf assembly 110 (again, similar to that shown in FIGS. 4 and 4A). Preferably, the tubes are substantially concentric, but need not be so. in another embodiment, collapsible member 150 may be a plurality of "arms" that slide along the length of each other (similarly to drawer glides), or can be slotted along the length with appropriate openings and connections therefor and are likewise joined to each other and weight box 131 and back holder 140 by hinges 151. Such configurations and other will be easily envisioned by those of skill in the art.

Weighted pusher assembly 120 shown in FIGS. 1, 4 and 4A operates as follows. In a basic explanation, the rolling shelf comprises rollers 110, rolling support bars 115 and rolling shelf base 114. Front slots 118 and rear slots 117 along the width of rolling shelf assembly 110 are provided for insertion of dividers (not shown) for dividing merchandise types/brands. Furthermore, front and rear extensions 112 and 117, respectively, affixed at the front and rear edges of the shelf assembly 110, accept front stop 113 and rear stop (not shown), respectively. Dimensions for any weighted pusher assembly are designed to allow weight box 131 to abut front stop 113 when all merchandise packages have been removed. Back holder feet 710 (best seen in FIG. 7) are inserted into rear divider slots 116, securely locking back holder 140 into place on rolling shelf assembly 110. As mentioned above, preferably all five (5) hinges 151 are designed to not be at one horizontal level, allowing for easy movement of the weight box 131 both forward and backward. In the embodiment shown in FIGS. 1, 4 and 4A, and also as mentioned above, the second and fourth hinges 151 are designed to be higher than the first, third and fifth hinges 151, particularly when weight box 131 touches front stop 113 (i.e., the "empty shelf position"). Pushing merchandise packages against weight box 131 (i.e., feeding merchandise between front stop 113 and weight box 131), causes second hinge 151 to move upward to create a gap between front stop 113 and weight box 131. Following this, a second merchandise package can then be inserted, and so on. Merchandise packages do not fall down backwards due to the resistance provided by weight box 131. This is particularly applicable for thinner, light-weight and/or small packages.

Figure 2:
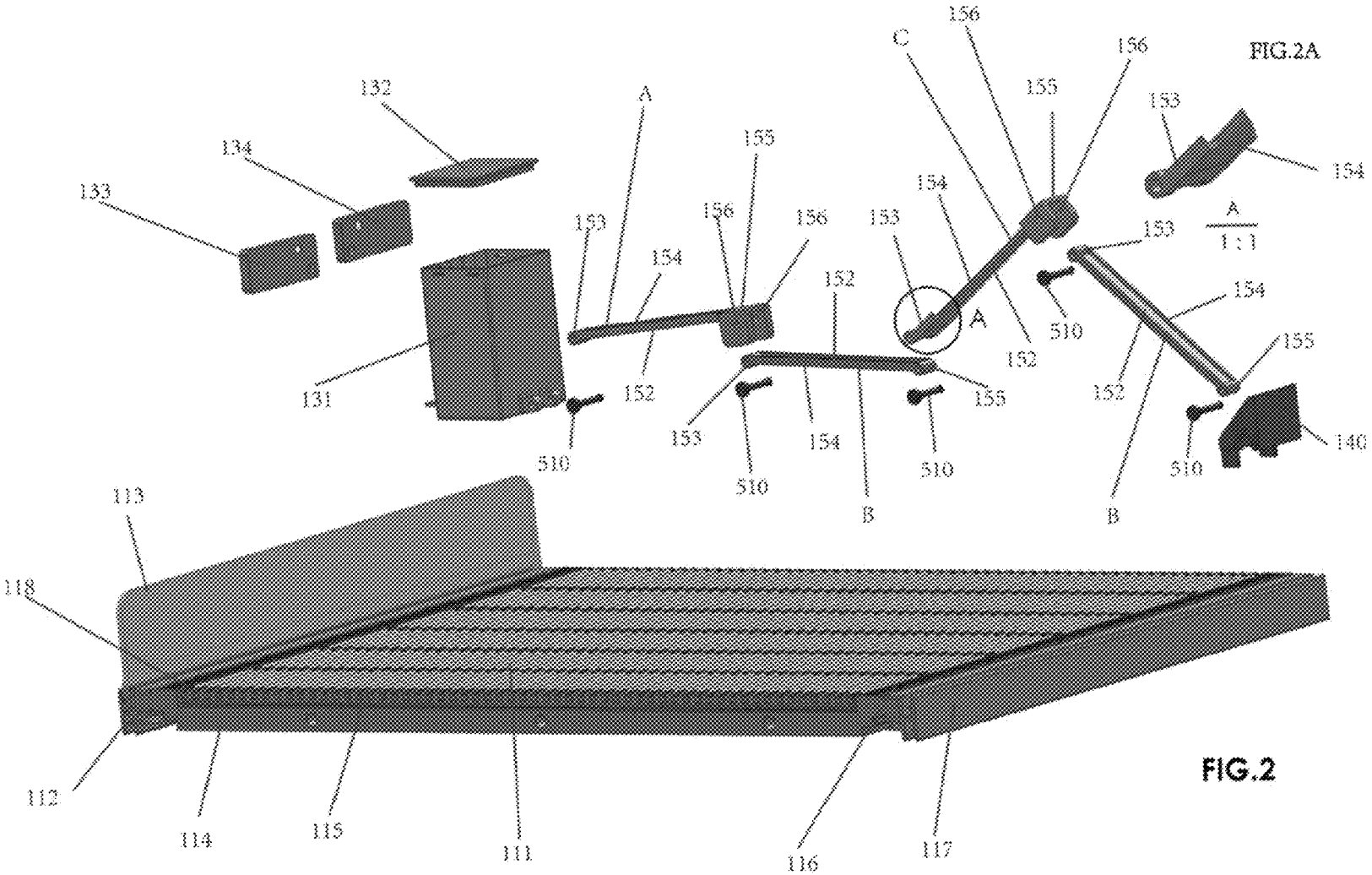
FIG. 2 is an exploded view of the weighted pusher assembly of FIG. 1 of the present disclosure.

FIG. 2 shows an exploded view of weighted pusher assembly 120 and the structures of the various arms 152 of the embodiment shown in FIGS. 1, 4 and 4A. Each arm 152 comprises three (3) main sections: a head 153, a bar 154 and a rear end 155. For purposes of the following discussion arms 152 have been designated as arm "'A", arm "B" or arm "C", with arm "A" connected to weight box 131, one arm "B" connected to arm "A", one arm "B" connected to back holder 140, and arm "C" connected to both arms "B". In detail, in the preferred embodiment shown in FIGS. 1, 4 and 4A, arm "A" comprises a sleeve as head 153, two rims along the length of bar 154 and an upside-down U-hinge holder with a hole 156 on each side as the rear end 155. Each of the two arms "B" comprises a sleeve as head 153, two rims along the length of bar 154 and a sleeve as rear end 155. Arm "C" comprises a clip with one hole on each side as head 153 see, FIG. 2A), a center rim along the top of the length of bar 154 and an upside-down U-hinge holder with a hole 156 on each side as rear end 155.

Figures 3, 3A, 3B:
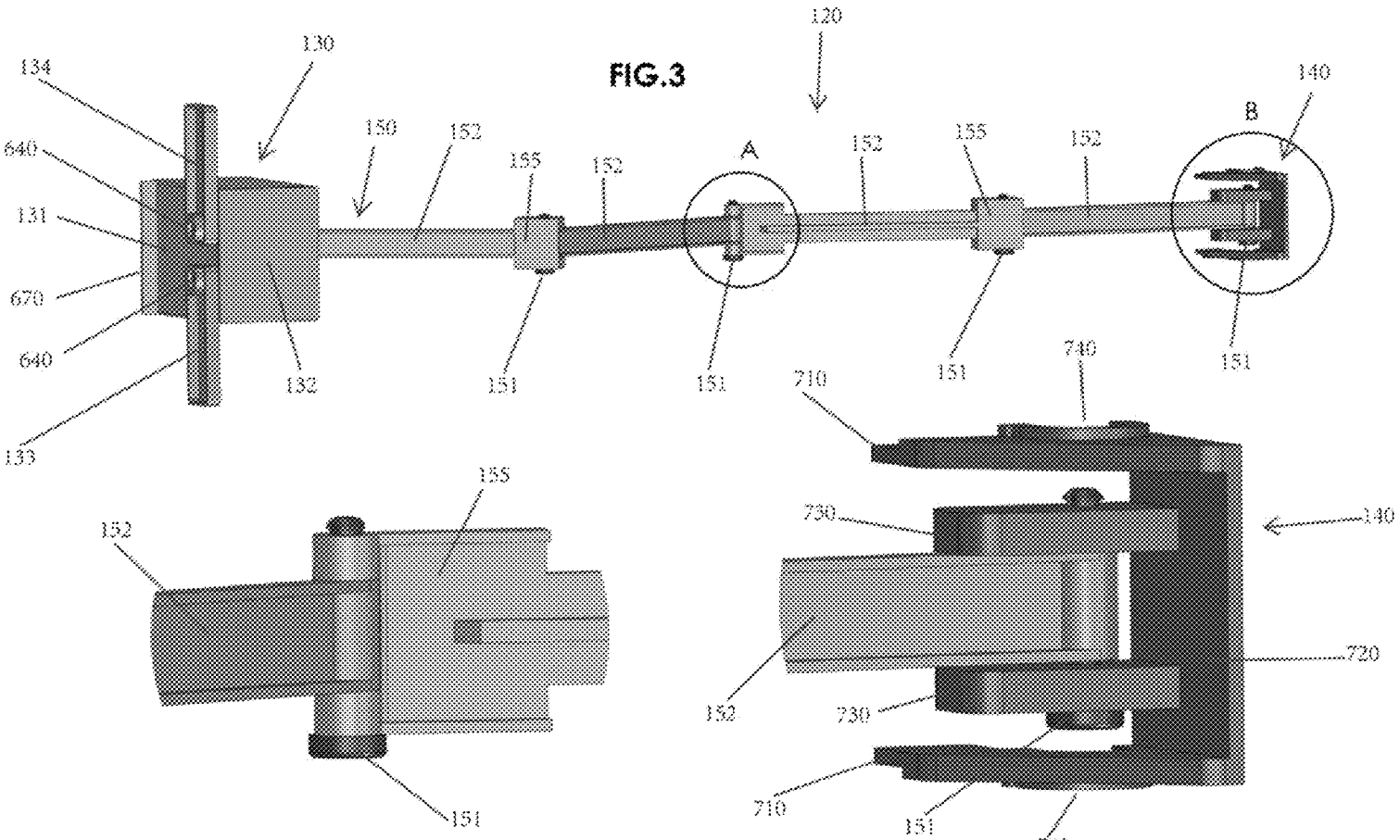
FIG. 3 is an overhead view of the weighted pusher assembly of FIG. 1 of the present disclosure having the collapsible member in an extended position.
FIG. 3A is a detail view of "A" of FIG. 3.
FIG. 3B is a detail view of "B" of FIG. 3.

FIGS. 2, 3, 3A and 3B show the connections between adjacent pairs of arms 152 (arm "A" to first arm "B", first arm "B" to arm "C" and arm "C" to second arm "B"), between weight box 131 and arm 152 (arm "A"), and between arm 152 (second arm "B") and back holder 140 to form the five (5) hinges 151 of the embodiment of FIGS. 1, 4 and 4A. In detail, for the connection of arm 152 (arm "A") to weight box 131, first hinge 151 is created by a hinge pin 510 (see detail of hinge pin 510 in FIG. 5) that is passed through two ring holes 610 (see detail of holes in FIG. 6A) of weight box 131 and the sleeve as head 153 of arm "A". Next, second hinge 151 is formed by placing hinge pin 510 through the two upside-down U-hinge holder holes 156 of rear end 155 of arm 152 (arm "A") and the sleeve as head 153 of arm 152 (first arm "B"). Hinge pin 510 is then inserted through two clip holes of arm 152 (arm "C") and the sleeve as rear end 155 of arm 152 (the first arm "B") to form the third hinge 151. Next, hinge pin 510 passes through the two upside down U-hinge holder holes 156 of rear end 155 of arm 152 (arm "C") and the sleeve as head of arm 152 (second arm "B") to form the fourth hinge 151. Finally, hinge pin 510 is passed through the two hinge tab holes 715 (see, FIG. 7) of back holder 140 and the sleeve as rear end 155 of arm 152 (second arm "B") to form the fifth hinge 151. FIGS. 3A and 3B show details of the third hinge 151 and the fifth hinge 151.

Figure 5:
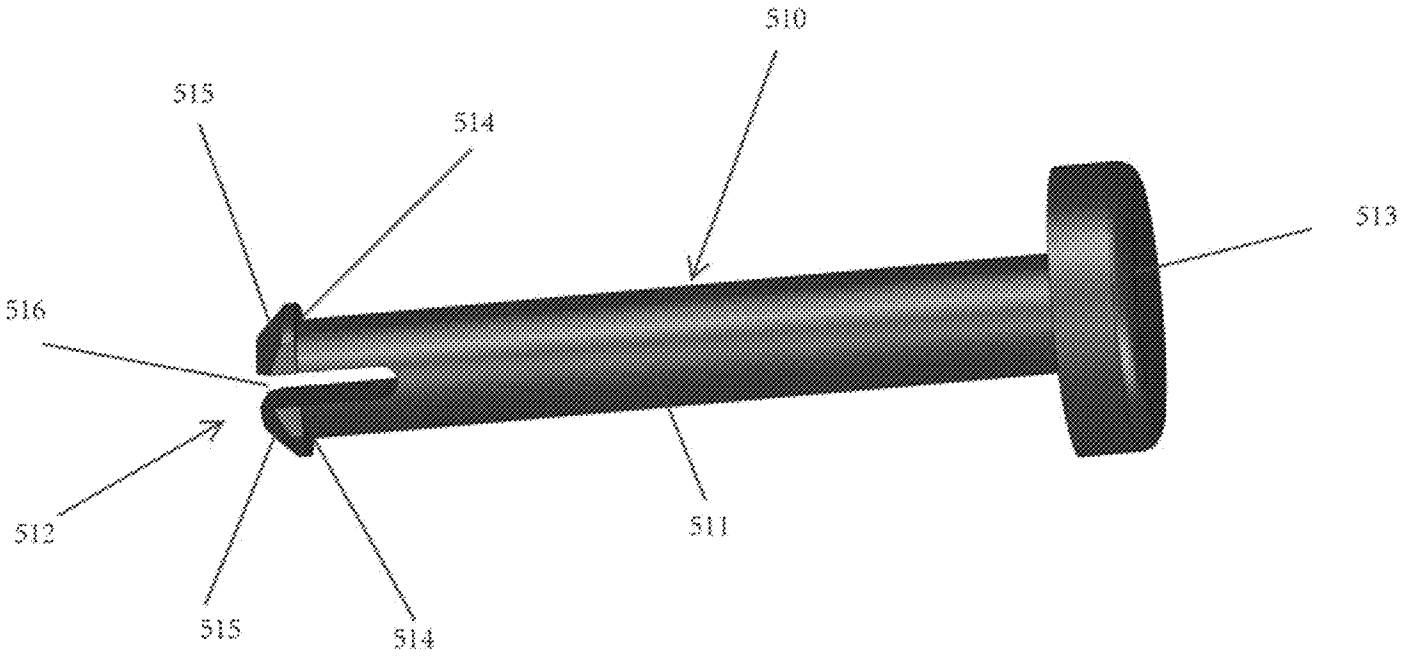
FIG. 5 is a close up view of a hinge pin for a hinge of the weighted pusher assembly of FIG. 1 of the present disclosure.

FIG. 5 shows the structure of hinge pin 510 of the embodiment shown in FIGS. 1, 4 and 4A, comprising a round pin rod 511, a front clip 512 and a hinge pin cap 513. There are locking tabs 514 on front clip 512 of hinge pin 510 and the locking tabs 514 have a beveled leading edge 515 to assist in simple and easy passage of hinge pin 510 through the holes and sleeves of the respective hinges, as the case may be. Front clip 512 of hinge pin 510 is provided with a slotted opening 516 that allows the opposing locking tabs 514 to be slightly compressed as front clip 512 passes through the respective sleeves and holes of arms 152. As can be appreciated by those of skill in the art, the hinge pin 510 of the specific embodiments shown in the FIGS. 1-7 is designed to provide a most efficient yet flexible function within the respective hinges. Of course, alternative methods of connection between the various arms 152 can be envisioned, including screws with cap nuts, pop rivets, ball bearing assemblies and other mechanisms for connecting and allowing the range of motion of hinges known to those of skill in the art.

Figure 6A:
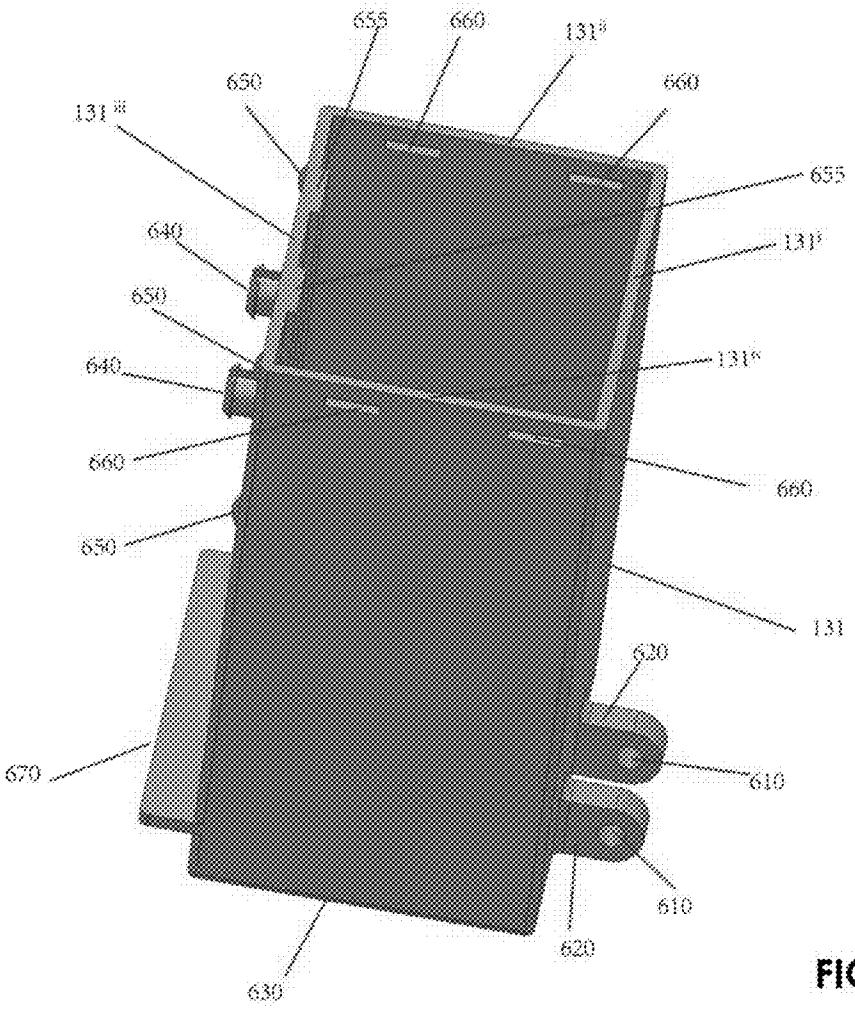
FIG. 6A is a right side overhead perspective view of the weighted member of the weighted pusher assembly of FIG. 1 of the present disclosure having the weighted member cap removed.

FIGS. 6A, 6B, 6C and 6D show details of the structure of weight box assembly 130 of the embodiment of the present disclosure which comprises weight box 131, weight box lid 132, right extension panel 133 and left extension panel 134. As shown in FIG. 6A, weight box 131 has four walls 131', 131", 131''' and 131$^{iv}$. FIG. 6A shows weight box 131 having two hinge rings 620 each with one ring hole 610 located on wall 131' proximal the base 630 of weight box 131, two pins 640 disposed proximal top of wall 131''', four positioning round tabs 650 disposed on wall 131''', two vertically disposed raised bands 655 disposed on the inner surface of wall 131''', four weighted box lid slots 660, two each disposed on wall 131" and wall 131$^{iv}$, and one front bottom rim 670 disposed proximal the base 630 of weight box 131 on wall 131'''. Hinge rings 620 are designed to mate with the sleeves as the head of arm 152 (arm "A") and hinge pin 510 to form first hinge 151. The two pins 640 are designed to cooperatively operate with the right and left extension panels 133 and 134, as are the four positioning round tabs 650 that are designed to secure right and left extension panels 133 and 134 in retracted or extended position, as will be described in more detail with respect to FIGS. 6B and 6C. The two vertically disposed raised bands 655 and the four weighted box lid slots 660 are designed cooperatively operate with weight box lid 132 as will be explained with respect to FIG. 6D. The front bottom rim 670 is designed to maintain a flush face between merchandise packages and right and left extension panels 133 and 134, such that right and left extension panels 133 and 134 do not become "pinched" against merchandise packaging.

Figure 6B:
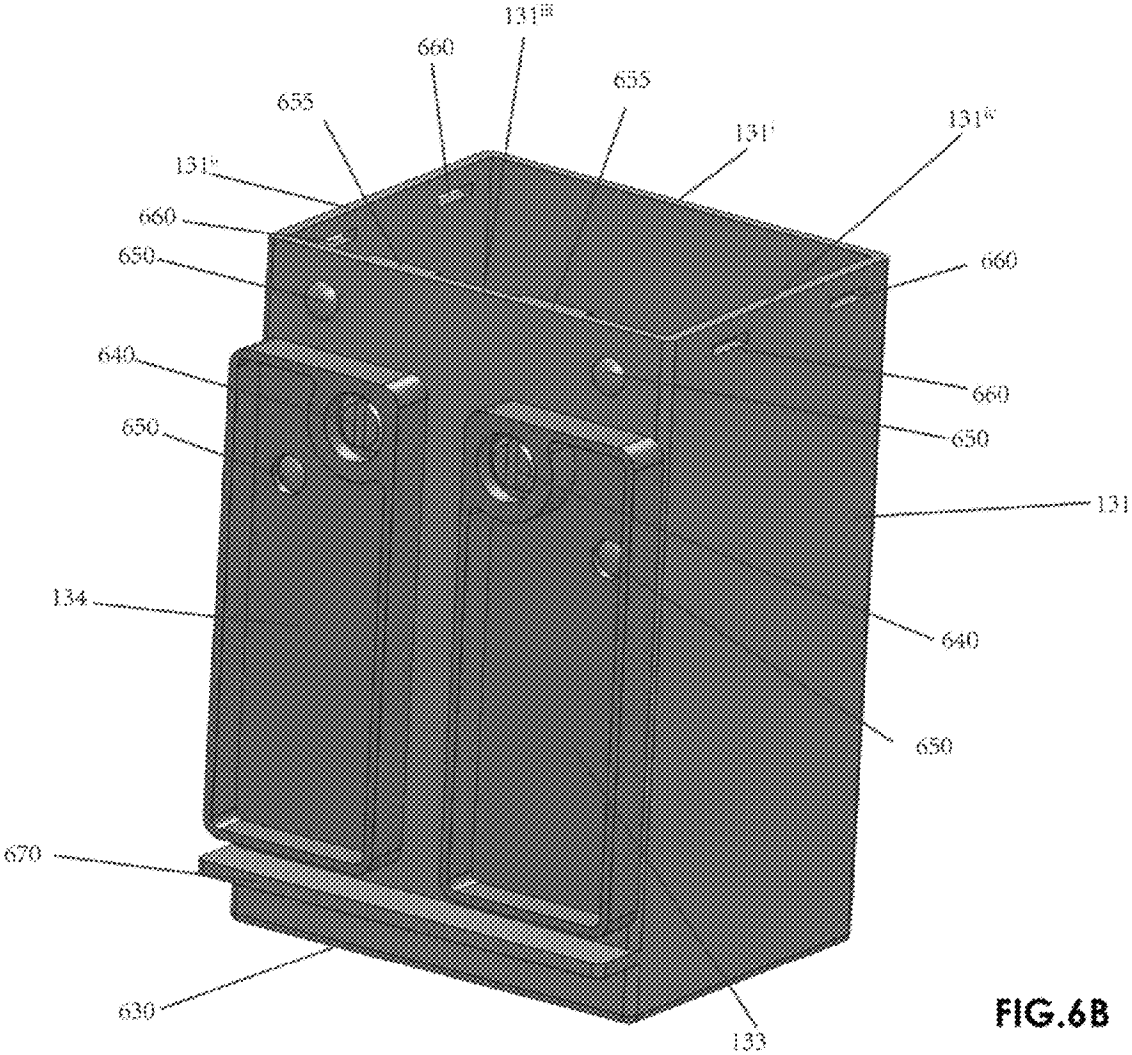
FIG. 6B is a right side front perspective view of the weighted member of FIG. 6A having optional extension panels in a non-deployed position.
Figure 6C:
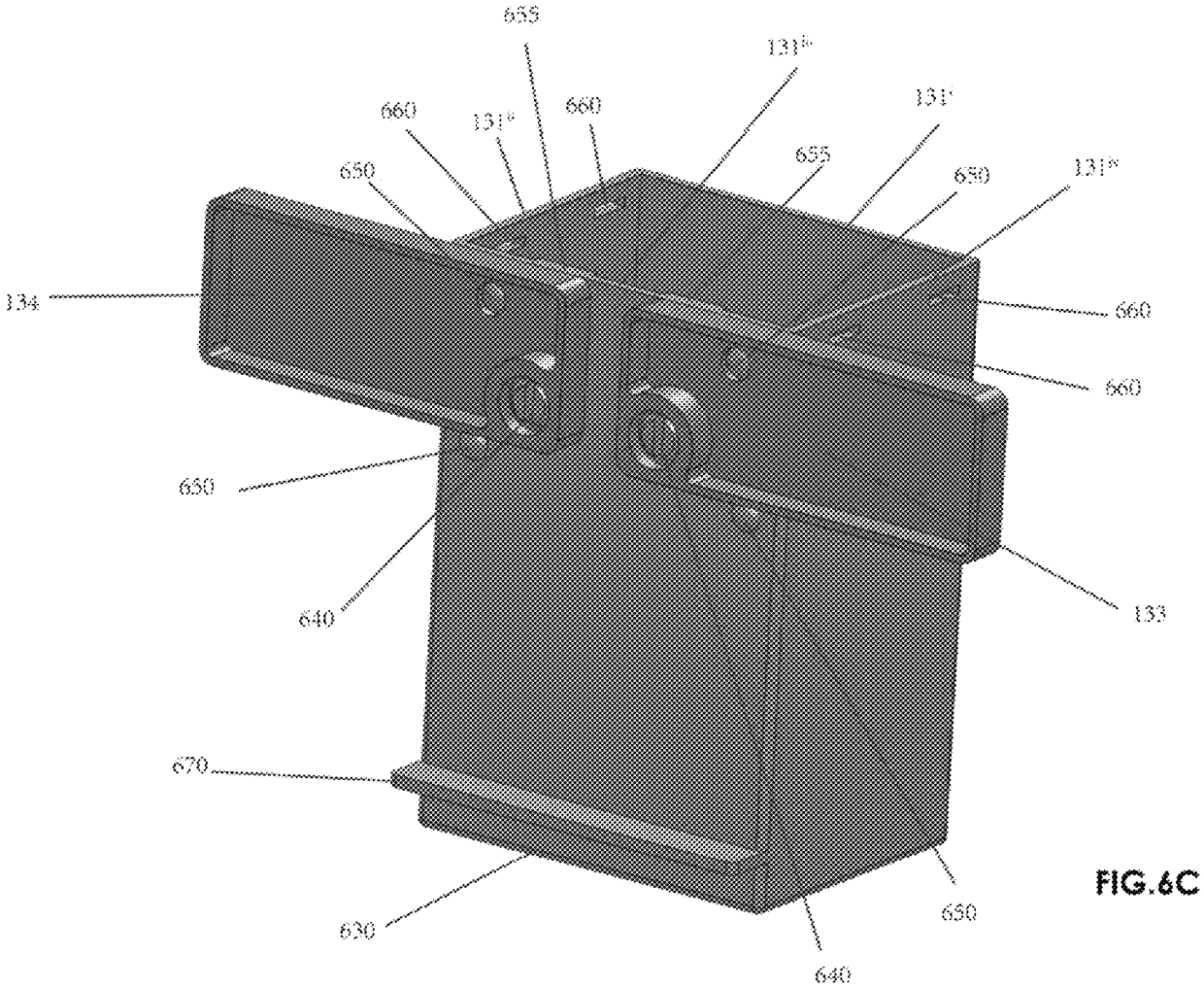
FIG. 6C is a right side front perspective view of the weighted member of FIG. 6A having the optional extension panels in a deployed position.

FIGS. 6B and 6C show right and left extension panels 133 and 134 in a retracted and extended position, respectively. Normally, right and left extension panels 133 and 134 are secured in the retracted position as shown in FIG. 6B by two pins 640 and two low-positioned round tabs 650. Right and left extension panels 133 and 134 are designed to increase the effective width of weight box 131 by rotating to a horizontal position by pivoting on pins 640, over the two upper-positioning round tabs 650 as shown in FIG. 6C. Upper positioning round tabs 650 secure right and left extension panels 133 and 134 in extended position.

Figure 6D:
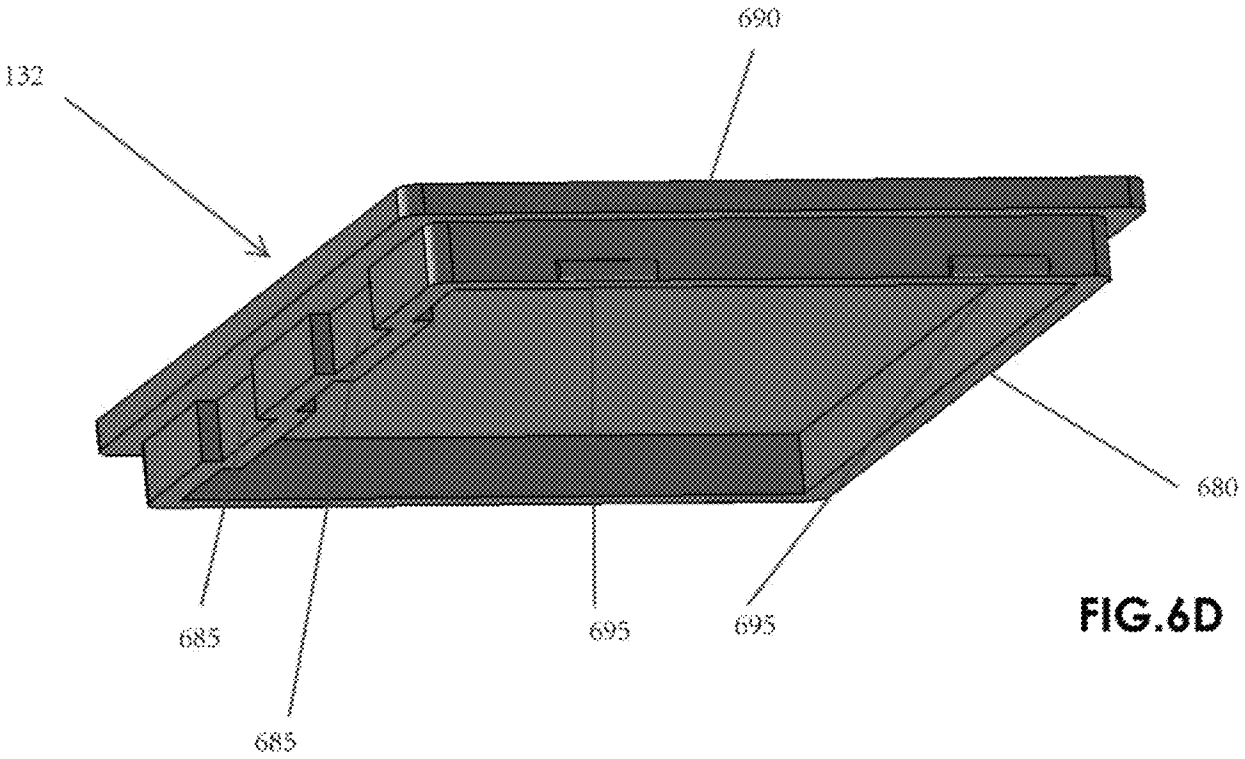
FIG. 6D is an underneath perspective view of a weighted member cap of the present disclosure.

FIG. 6D shows a detail of weight box lid 132. Weight box lid 132 has an inner flange rim 680 disposed around and away from the perimeter and on the underside of weight box lid 132 opposite upper surface 690 of weight box lid 132. The "U-jag" 685 on inner flange rim 680 is designed to cooperatively mate with the two vertically disposed raised bands 655 disposed on the inner surface of wall 131''' so as to form a locking system for weight box lid 132 and weight box 131. Tabs 695 disposed on inner flange rim 680 (tow each on opposing walls of inner flange rim 680 are designed to cooperatively mate with the four weighted box lid slots 660, two each disposed on wall 131" and wall 131$^{iv}$. When weight box 131 has an open design structure as shown in the embodiment of the FIGS. 1-6 is used, material such as steel, concrete, sand or stone, etc., can be placed in weight box 131 to provide the mass for the driving force needed to push merchandise packages forward as well as overcome the tendency of merchandise packages to fall backward when inserted in the front. In the embodiment shown in the FIGS., the amount of weight added to weight box 131 can be varied according to need. The shape, dimensions and weight of any particular weight box 131 can be designed for specific merchandise packages and shelves also according to need. Of course, as will be appreciated by those of skill in the art, weight box 131 may be replaced with a solid plate of, e.g., metal, plastic, or other material. When this type of replacement for weight box 131 is used, especially in the case of plastic, weighted strips of a suitable material may be added to the solid plate to provide the amount of weight desired so as to advance weighted pusher assembly 120 against merchandise packages due to the effect of gravity and to extend collapsible member 150.

Figure 6F:
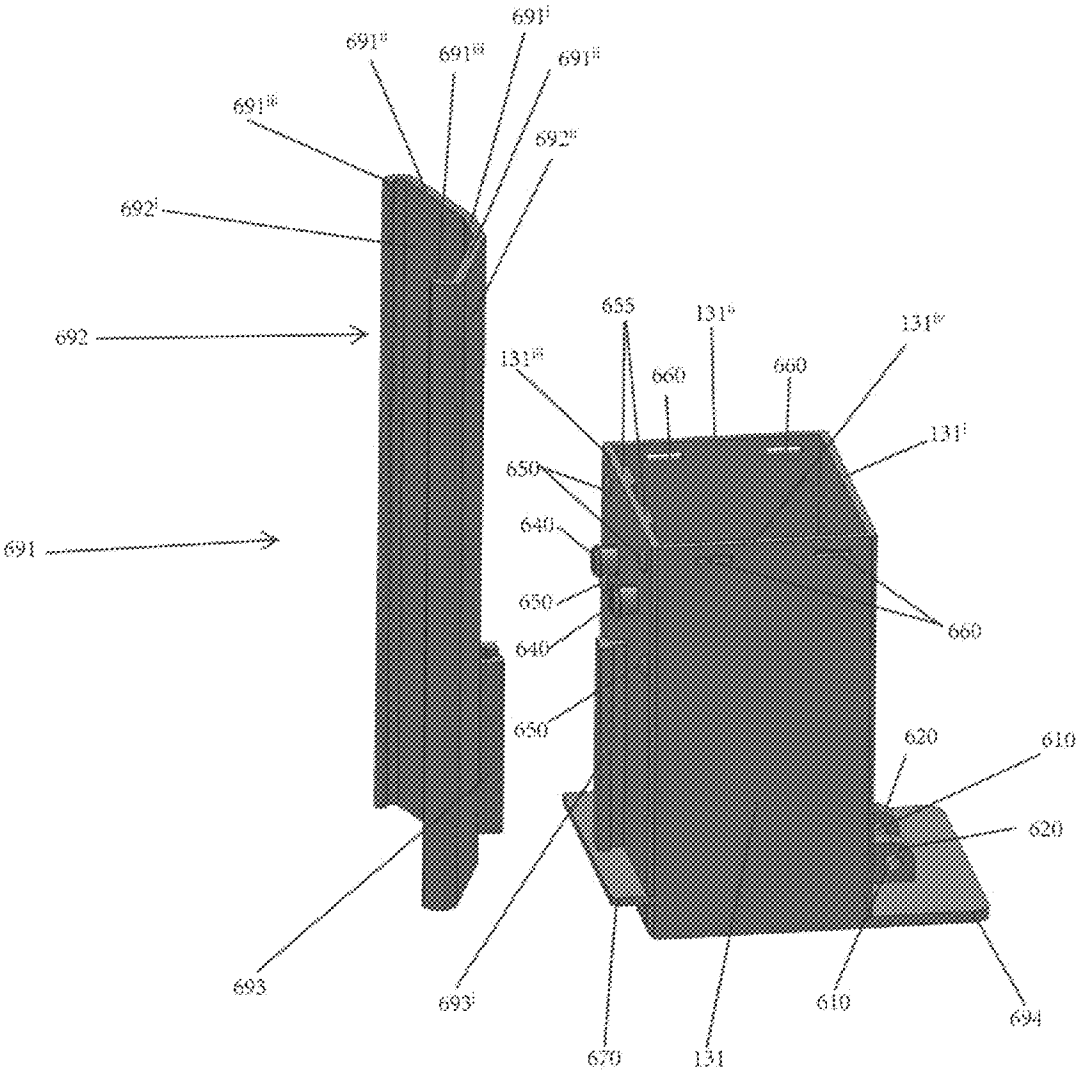

FIGS. 6E and 6F show alternative embodiments of weighted pusher assembly 130. The alternate embodiment of weighted pusher assembly 130 shown in FIGS. 6E and 6F includes modifications to weight box 131 and the addition of adapter 691 to weight box 131. Adapter 691 is referred to herein as an "angled hooked panel" comprising three sub-panels: center panel 691' and two adjacent panels 691", forming an angled multi-panel configuration and, at each end of panels 691" a "hook" element 691'''. This "angled hooked panel" is used to hold merchandise package as a clip. As an option hook elements 691''' may be omitted and "angled hook panel" becomes a substantially planar "angled panel" front without "hook" element 691". Various other designs of adaptors will suggest themselves to one f skilled in the art based on the present disclosure. Adaptor 691 includes a front side 692' and a rear side 692" and a connector 693 disposed on rear side 692" in association with center panel 691'. The modifications to weight box 131 include the addition of an adapter holder 693' disposed on wall 131''' above and perpendicular to front bottom rim 670 and the addition of a rear base 694 disposed substantially perpendicular to wall 131' at bottom 630 of weight box 131 and below hinge rings 620. FIG. 6E shows adapter 691 connected to weight box 131 and FIG. 6F shows adapter 691 and weight box 131 not connected. Connector 693 and adapter holder 693' are designed to be matingly engageable so as to provide a connection for adapter 691 to weight box 131. In the embodiment shown in FIGS. 6E and 6F, connector 693 is in a "T"-channel configuration, while adapter holder 693' is in a "T" configuration designed to engage the "T"-channel of connector 693. In FIGS. 6E and 6F adapter 691 is shown as an elongated three-panel angled member that is designed and adapted to be disposed substantially perpendicular to front bottom rim 620 when in place on adapter holder 693'. Of course, many other designs of adaptor holder 693' are possible, such as snaps, the channel being located on adaptor holder rather than on adaptor, various configurations of channel and matching engagement, all of which will suggest themselves to one of skill in the art based on the present disclosure. Adapter 691, in the configuration shown in FIGS. 6E and 6F is adapted to provide support and forward-urging movement to taller and/or narrower and/or special bottom-configured merchandise packages. Of course, dimensions and shapes of adapter 691 can be designed to match any merchandise package as will be apparent to those of skill in the art. Rear base 694 of weight box 131 is designed and configured to balance the mass of adapter 691 when adapter 691 is connected to adapter holder 693' so that weight box 131 remains stably on rollers 111 of shelf assembly 110.

Figure 7:
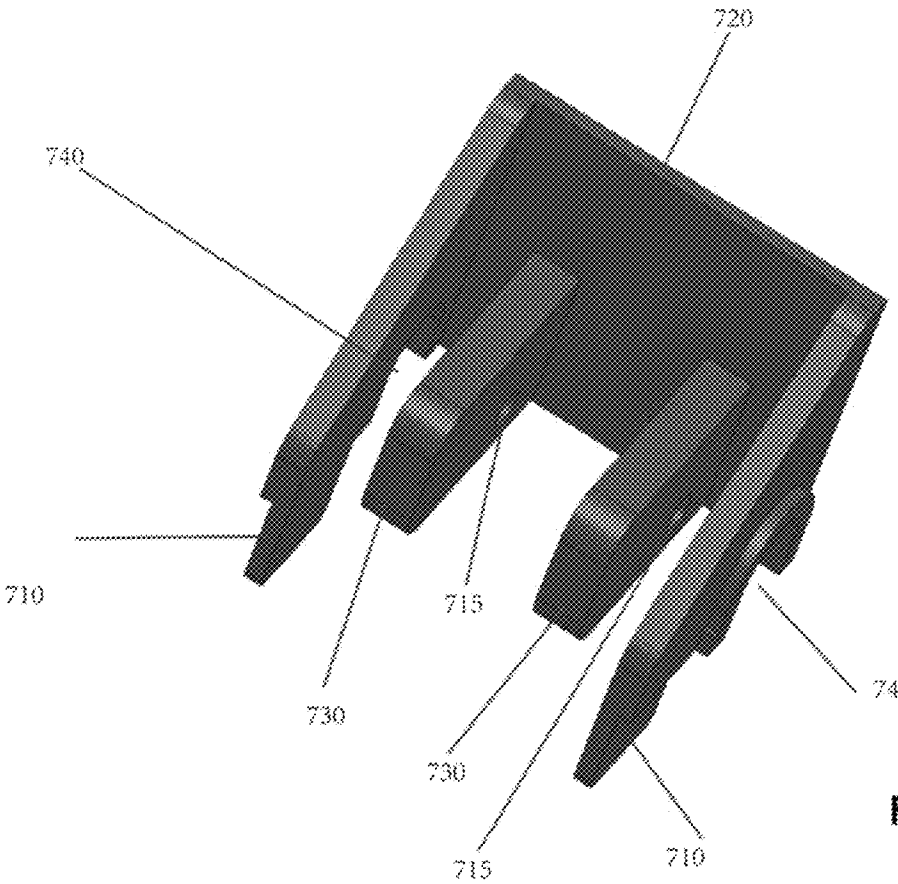
FIG. 7 is a front overhead perspective view of a fastener the weighted pusher assembly of FIG. 1 of the present disclosure.

FIG. 7 shows the detail of the back holder 140. Back holder 140 comprises a back panel 720, two hinge tabs 730 each having a hinge tab hole 715 and left and right back holder feet 710. The structure of back holder 140 serves to provide a strong and firm base structure for the entire weighted pusher assembly 120. The left and right back holder feet 710 are inserted into rear divider slots 116 as shown in, e.g., FIG. 1, and may be secured to rear divider slots 116 by a suitable locking device. The two hinge tabs 730 each with one hinge tab hole 715, and the two openings 740 are designed to work with the sleeve as rear end of arm 152 (second arm B) to form the fifth hinge 150. Back holder 140 stands upright on gravity rolling shelves or other gravity shelves.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A weighted pusher assembly for advancing a plurality of merchandise packages by gravity along an inclined shelf surface, wherein the inclined shelf surface is comprised of a gravity roller shelf having a first edge positioned proximal the plurality of merchandise packages and a second edge positioned distal the plurality of merchandise packages, the weighted pusher assembly comprising:

a first end comprised of a weighted member that contacts and is configured to move on the inclined shelf surface, wherein the weighted member has a front side disposed toward the first edge and a rear side disposed toward the second edge;

a second end comprised of a fastener, wherein the fastener is affixed to the second edge of the shelf to provide longitudinal stability to the weighted pusher assembly; and a collapsible member disposed between the first and second ends, wherein the collapsible member comprises a plurality of at least four arms connected by five hinges, each arm having a length, a top surface disposed away from the inclined shelf and a bottom surface disposed toward the inclined shelf, wherein a first arm of the at least four arms is connected to the fastener by a first hinge, and wherein the first arm is rotatably held in the fastener by the first hinge in a fixed position proximal the shelf surface, wherein a second arm of the at least four arms is connected to the weighted member by a second hinge, wherein a third arm of the at least four arms is connected to the first arm by a third hinge, wherein a fourth arm of the at least four arms is connected to the second arm and the third arm by fourth and fifth hinges, respectively, wherein the first, second and fourth arms each has two rims disposed along the length of the arms to provide longitudinal stability to the arms, wherein each of the two rims is disposed away from the top surface and the bottom surface of the arms, wherein the third arm has a ridge disposed along the length on the top surface and/or the bottom surface to provide vertical stability to the arm, wherein the collapsible member is collapsible between a first extended position and a second collapsed position, and wherein the vertical stability of the third arm maintains the fifth hinge in contact with the gravity roller shelf.

2. A weighted pusher assembly according to claim 1, wherein the weighted member is selected from the group consisting of a solid plate, a hollow container having an interior volume for holding a substance that provides mass to the hollow container and combinations of the foregoing.

3. A weighted pusher assembly according to claim 2, wherein the weighted member comprises a solid plate comprised of plastic, metal or any combinations thereof.

4. A weighted pusher assembly according to claim 3, further comprising an additional amount of weight applied to the solid plate.

5. A weighted pusher assembly according to claim 2, wherein the weighted member comprises a hollow container having a shape selected from a rectangular, a square, an oval, a circle, a triangle shape.

6. A weighted pusher assembly according to claim 5, wherein the substance placed in the interior volume that provides mass is selected from metal beads, sand, concrete, powder metal, a fluid enclosed in a container and any combinations of the foregoing.

7. A weighted pusher assembly according to claim 1, wherein the weighted member further comprises at least one extendible panel attached to the weighted member proximal the merchandise package, wherein the at least one extendible panel is disposed on the front side of the weighted member, and wherein the at least one extendible member is configured to rotate so as to provide additional width to the front side of the weighted member.

8. A weighted pusher assembly according to claim 1, wherein the fastener is affixed to the second edge of the shelf such that the fastener can withstand the force applied to the weighted pusher assembly during restocking of merchandise on the shelf.

* * * * *